US006370327B1

(12) United States Patent
Seguy et al.

(10) Patent No.: US 6,370,327 B1
(45) Date of Patent: Apr. 9, 2002

(54) EMITTER OF INFRARED RADIATION IN BAND III AND COMPOSITE ALLOWING THE EMISSION OF SUCH RADIATION

(75) Inventors: Patrice Seguy, Igny; Valérie Alonso, Nanterre, both of (FR)

(73) Assignee: Aerospatiale Matra Missiles, Paris (FR)

( * ) Notice: Subject to any disclaimer, the term of this patent is extended or adjusted under 35 U.S.C. 154(b) by 0 days.

(21) Appl. No.: 09/620,646

(22) Filed: Jul. 20, 2000

(30) Foreign Application Priority Data

Jul. 21, 1999 (FR) ..... 99 09436

(51) Int. Cl.[7] ..... H05B 3/00
(52) U.S. Cl. ..... 392/407; 219/553; 250/504 R
(58) Field of Search ..... 392/407, 435, 392/432, 422, 426; 219/553; 250/495.1, 504 R, 493.1; 501/108, 127, 126

(56) References Cited

U.S. PATENT DOCUMENTS

| | | | | |
|---|---|---|---|---|
| 3,445,662 A | * | 5/1969 | Langley | 392/426 |
| 4,740,669 A | * | 4/1988 | Takimae | 392/407 |
| 4,774,396 A | * | 9/1988 | Salit et al. | 219/553 |
| 4,824,730 A | | 4/1989 | Fukuda et al. | |
| 5,028,760 A | | 7/1991 | Okuyama | |
| 5,285,131 A | | 2/1994 | Muller et al. | |
| 5,356,724 A | | 10/1994 | Tsuda et al. | |
| 5,405,680 A | * | 4/1995 | Chang et al. | 428/212 |
| 5,607,609 A | * | 3/1997 | Sakuyama et al. | 392/436 |
| 6,205,674 B1 | * | 3/2001 | Kaizuka | 219/553 |

FOREIGN PATENT DOCUMENTS

| | | | |
|---|---|---|---|
| GB | 2147777 | * | 5/1985 |
| JP | 61-115968 | * | 6/1986 |
| JP | 64-67885 | * | 3/1989 |
| JP | 1-141622 | * | 6/1989 |
| JP | 5-230692 | * | 9/1993 |
| JP | 9-14833 | | 1/1997 |
| JP | 10-110278 | * | 4/1998 |

* cited by examiner

*Primary Examiner*—John A. Jeffery
(74) *Attorney, Agent, or Firm*—Stevens, Davis, Miller & Mosher, LLP

(57) ABSTRACT

The invention relates to an emitter of infrared radiation in band III as well as to a composite allowing the emission of such infrared radiation. The emitter includes an emission source having a composite on which a thin oxide layer is deposited. The oxide has an emissivity which is less than 0.2 for wavelengths of emitted radiation of less than 6 $\mu$m and greater than 0.8 for wavelengths of between 8 and 10 $\mu$m. The invention also includes a heating device which can heat the composite so that it emits infrared radiation in band III.

8 Claims, 2 Drawing Sheets

EMITTER OF INFRARED RADIATION IN BAND III AND COMPOSITE ALLOWING THE EMISSION OF SUCH RADIATION

BACKGROUND OF THE INVENTION

A. Field of the Invention

The present invention relates to an emitter of infrared radiation in band III and to a composite allowing the emission of such infrared radiation.

B. Discussion of the Related Art

Emitters of infrared radiation in band II (wavelengths of the infrared radiation from 3 to 5 $\mu$m) are known which can be mounted on a flying craft, for example a target airplane, in order to simulate the optical signature of certain types of aircraft particularly for the purpose of carrying out test firings for weapons, such as aircraft-destroying missiles.

The present invention relates to an emitter capable of emitting infrared radiation in band III (8 to 12 $\mu$m in wavelength) and intended, in particular, to be used in the same type of application, in order to simulate the optical signature of other types of aircraft.

It is known that, for such applications (mounting on an aircraft flying at high speed, in order to simulate the optical signature of airplanes emitting in band III), the emitter must have particular characteristics, especially relating to:

- the luminance, which must be of the order of 100 W/sr between wavelengths of 8 and 10 $\mu$m;
- the capability of withstanding the mechanical and climatic environmental stresses, which has to be compatible with the envisioned operating conditions (mounting on a flying craft able to fly at a speed close to Mach 1 and able to ascend to an altitude of 4000 m);
- the overall size (the emissive surface area must remain less than a few hundred $cm^2$); and
- the cost, which must remain low.

Many solutions are conceivable, but none of them allows all the aforementioned conditions to be met. By way of illustration, mention may be made of:

- a pyrotechnic solution using a powder tracer. The implementation of such a solution and, especially, the maintenance of stable combustion appear to be difficult, if not impossible, under the operating conditions envisioned. In addition, the luminance power capable of being emitted in band III seems to be insufficient;
- a solution using a laser. This solution is prohibitive in terms of cost, weight, size and autonomy; and
- Nernst lamps (bars of refractory material heated by resistance heating). These lamps are too fragile and the power emitted in band III is greatly insufficient for the applications envisioned.

Moreover, a device is known for simulating a signature in band III which is based on the emission of a highly emissive heated body. This known device comprises a metal dome which is heated by a propane burner. Said device makes it possible to attain a luminance of the order of 40 W/sr when it is mounted on a flying craft which flies at moderate speed (75 m/s).

However, this known device cannot be used for the applications envisioned in the present invention. This is because:

- the luminance level obtained is insufficient (40 W/sr instead of 100 W/sr); and, in addition,
- the cooling due to the aerodynamic flux at the high flight speed envisioned (280 m/s) would cause the temperature of the dome to drop and the luminance level to fall.

SUMMARY OF THE INVENTION

The object of the present invention is to remedy these drawbacks. It relates to a less-expensive and more compact emitter, making it possible to emit infrared radiation in band III, which has the aforementioned characteristics and which can be used in the applications indicated above.

For this purpose, according to the invention, said emitter of infrared radiation in band III is noteworthy in that it comprises:

- an emission source comprising a composite which includes a standard and common metal, for example copper or nickel, on which a thin oxide layer, for example having a thickness of the order of 50 $\mu$m, is deposited, said oxide having, in addition, an emissivity which is:
- less than 0.2, at least for wavelengths of emitted radiation of less than 6 $\mu$m; and
- greater than 0.8 for wavelengths of between 8 $\mu$m and 10 $\mu$m; and
- a heating device which can heat said composite so that it emits infrared radiation in band III.

Thus, in particular by virtue of the emissivity characteristics of said oxide (for example aluminum, magnesium or yttrium oxide), the emitter according to the invention is able to emit radiation in band III with high enough luminous energy for the applications envisioned. In addition, since the radiation emitted has a very low luminance in band I (1 $\mu$m–1.5 $\mu$m) and band II (3 $\mu$m–5 $\mu$m), the energy consumption is consequently reduced, thereby making it possible to optimize the overall energy yield of said emitter.

It should be noted that, by definition, the emissivity of a body is a dimensionless parameter, which expresses the ratio of the luminance emitted by this body to the maximum luminance of an ideal body called "black body". The value of this parameter varies between 0 and 1, depending on the material and on the wavelength.

Furthermore, by depositing the oxide on a metal, the cost, robustness, machining, heating and supply problems, which would exist if the oxide were to be used by itself, under the surface-area (150 $cm^2$) and temperature (800° C.) conditions envisioned here, are solved.

In addition, the use of a metal (for example irradiated platinum, nickel, copper or titanium), combined with said heating device, allows effective heating of said composite to a prescribed temperature of between 500° C. and 1000° C., preferably about 800° C.

Preferably, said metal is hemispherical in shape and said oxide is deposited on the hemispherical external face of said metal.

Moreover, said heating device advantageously comprises means for controlling the heating temperature and it preferably heats by resistance heating. Other known heating modes may, of course, also be envisioned.

Furthermore, in one particular embodiment, the emitter according to the invention also includes:

- a reflector allowing the infrared radiation emitted by the emission source to be directed in a predefined solid angle, thereby making it possible to increase the overall yield of the emitter; and/or
- a casing which contains the emission source, so as to protect it from the outside, and which is provided with a window transparent to the infrared radiation emitted by said emission source, thereby making it possible in particular to isolate the emissive source from the external aerodynamic flux.

The present invention also relates to a composite comprising a metal and an oxide, for the emission of infrared radiation in band III, said composite and especially the oxide having the aforementioned properties.

BRIEF DESCRIPTION OF THE DRAWINGS

The figures of the appended drawing will make it clearly understood how the invention can be realized. In these figures, identical reference numbers denote similar components.

DETAILED DESCRIPTION OF THE INVENTION

Figure 1:
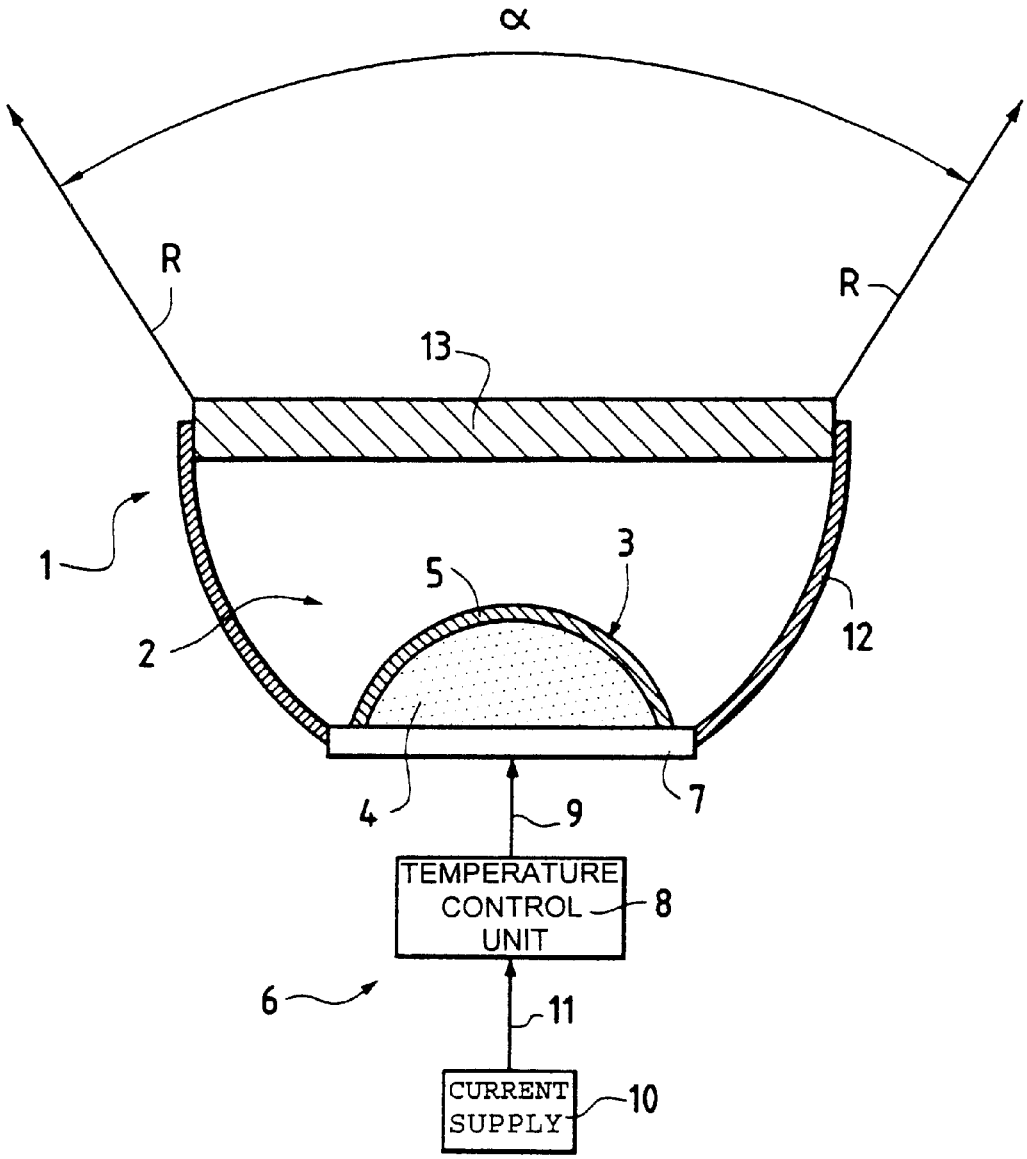
FIG. 1 shows schematically an emitter according to the invention.

The emitter 1 according to the invention, and illustrated schematically in FIG. 1, is intended to emit infrared radiation R in band III, this being explained in detail below.

Figure 2:
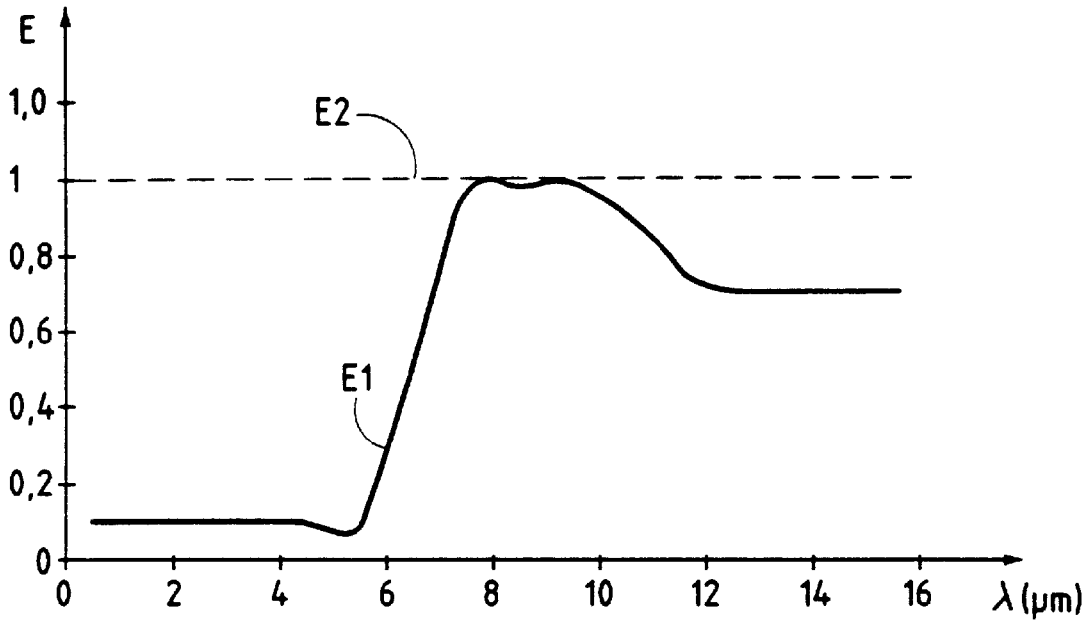
FIG. 2 illustrates curves showing the emissivity, as a function of wavelength, of a black body and of a composite according to the invention, respectively.

For this purpose, said emitter 1 comprises, according to the invention:

- an emission source 2 comprising a composite 3 which includes a metal 4 on which a thin oxide layer 5 is deposited, said oxide 5 having an emissivity El, as illustrated in FIG. 2, which is:
- less than 0.2, at least for wavelengths $\lambda$ of less than 6 $\mu$m; and
- greater than 0.8, and as close as possible to 1, for wavelengths $\lambda$ of between 8 $\mu$m and 10 $\mu$m; and
- a heating device 6 which can heat said composite 3 so that it emits infrared radiation in band III.

FIG. 2 also illustrates, as the broken line, the emissivity E2 of a perfect black body, which is assumed to be equal to 1 whatever the wavelength $\lambda$ in question.

The emissivity curve E1, illustrated in FIG. 2, corresponds to that of aluminum oxide ($Al_2O_3$) which is the preferred oxide for implementing the present invention.

However, other oxides may also be used for implementing the invention, and especially magnesium oxide or yttrium oxide.

It should be noted that the emissivity E for wavelengths $\lambda$ of greater than 10 $\mu$m does not matter within the context of the present invention since the energy emitted at such wavelengths is negligible.

It should also be noted that the use of a composite 3, whose emissivity is close to 1 in the useful band (band III) and almost zero for shorter wavelength ranges, makes it possible to limit the problems of heat build-up and to increase the yield.

In a preferred embodiment illustrated in FIG. 1, said metal 4, preferably a common metal, for example irradiated platinum, nickel, copper or titanium, has a hemispherical shape, for example with a diameter of 15 cm, and said oxide 5 is deposited on the hemispherical external face of said metal 4, thereby making it possible to obtain a high ratio of emissive surface area to overall size of said composite 3.

Preferably, said oxide 5 is deposited in the form of a thin layer, the thickness of which results from a compromise between the optical properties of the oxide used and the constraints associated with the deposition process employed, which thickness is, for example, close to 50 $\mu$m in the case of aluminum oxide.

Within the context of the present invention, said oxide 5 may be deposited by various known processes, for example by plasma sputtering. The choice of process depends, preferably, on the type of metal and on the type of oxide which are chosen. In particular, it is possible to use thermal spraying processes, a PVD (Physical Vapor Deposition) process or a CVD (Chemical Vapor Deposition) process.

Moreover, the heating device 6 comprises:

- known means 7, for example electrical resistance elements illustrated schematically and intended to heat said metal 4 by resistance heating;
- known means 8 for controlling the heating temperature, as illustrated by a link 9; and
- an electric current supply unit 10 connected via a link 11 to the means 8.

The heating device 6 is provided merely as a preferred example. Other known heating devices may, of course, also be used.

Moreover, according to the invention, said emitter 1 also includes:

- a metal reflector 12, for example of parabolic shape, centered about the composite 3 and allowing the infrared radiation R emitted by said emissive source 2 to be directed in a predefined solid angle $\alpha$, thereby making it possible to increase the overall yield of the emitter 1; and
- a casing, only a window 13 of which has been illustrated, intended to protect the emissive source 2 from the outside, and especially from the external aerodynamic flux when the emitter 1 is mounted on a flying craft. Said window 13 is, of course, transparent to said infrared radiation R.

Thus, by virtue of the invention, it is possible to emit infrared radiation R in band III (8–12 $\mu$m) which has a luminance of 100 W/sr between 8 and 10 $\mu$m, with an emissive surface area of, for example, 150 $cm^2$.

Figure 3:
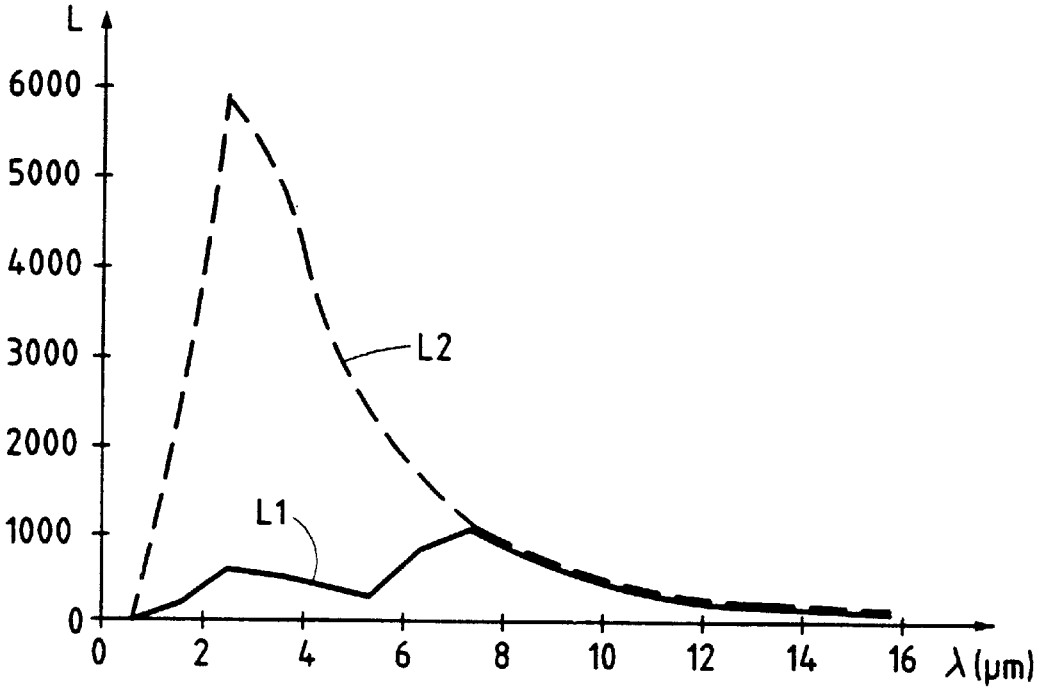
FIG. 3 illustrates curves showing the luminance, as a function of wavelength, of a black body and of an emitter according to the invention, respectively.

FIG. 3 illustrates the luminance L (in $W/st/m^2/\mu m$) for a temperature of about 800° C. corresponding to the preferred heating temperature, namely:

- on the one hand, the luminance L1 of the emitter 1 according to the invention; and
- on the other hand, by way of comparison, the luminance L2 of a black body, under the same operating conditions.

It may be clearly seen that the emitter 1 essentially emits in band III, whereas the black body has a very high luminance peak located between 2 and 3 $\mu$m.

It will be noted that, in addition to the aforementioned advantages, the invention makes it possible to achieve an effective compromise between size and yield of the emitter 1. This is because it will be recalled that, with regard to a black body, for temperatures of greater than 1000° C., the gain in luminance in band III becomes smaller and smaller, the energy emitted in band I becomes predominant and the band III/band I yield, which must be large in the applications envisioned in the present invention, drops. The optimum yield lies at moderate temperatures of 200° C. However, for such temperatures, the surface area of the materials which is needed to obtain the desired luminance (100 W/sr over 1.5 sr) in band III is prohibitive (approximately 10,000 $cm^2$). Consequently, by virtue of the invention a high yield is obtained using an emission source 2 having a small emissive surface area (150 $cm^2$) heated to a temperature of about 800° C.

By way of preferred, but nonexclusive, application, the emitter 1 according to the invention may be mounted on a flying craft, for example a target craft of the C22 type, in order to simulate the optical signature of an aircraft. In addition, the existence of a low luminance in the near infrared range prevents certain systems for guiding missiles for destroying said target craft, especially systems provided with a band I tracer, from being disturbed.

What is claimed is:

1. An emitter of infrared radiation in band III, said emitter comprising:

an emission source including a composite which includes a metal on which a thin oxide layer is deposited, said oxide having an emissivity which is:

less than 0.2, at least for wavelengths of emitted radiation (R) of less than 6 $\mu$m; and greater than 0.8 for wavelengths of between 8 $\mu$m and 10 $\mu$m; and a heating device for heating said composite so that it emits infrared radiation in band III, wherein said metal is hemispherical in shape and wherein said oxide is deposited on the hemispherical external face of said metal.

2. The emitter as claimed in claim 1, wherein said thin layer has a thickness of about 50 $\mu$m.

3. The emitter as claimed in claim 1, wherein said heating device comprises means for controlling the heating temperature.

4. The emitter as claimed in claim 1, wherein said heating device heats by resistance heating.

5. The emitter as claimed in claim 1, which also includes a reflector for allowing the infrared radiation (R) emitted by said emission source to be directed in a predefined solid angle.

6. The emitter as claimed in claim 1, which also includes a casing which contains the emission source, so as to protect it from the outside, and which is provided with a window transparent to the infrared radiation (R) emitted by said emission source.

7. A composite for the emission of infrared radiation in band III, said composite comprising: a metal and an oxide, wherein said oxide is deposited in the form of a thin layer on said metal and wherein said oxide has an emissivity which is:

less than 0.2, at least for wavelengths of emitted radiation less than 6 $\mu$m; and greater than 0.8 for wavelengths of emitted radiation between 8 $\mu$m and 10 $\mu$m, wherein said metal is hemispherical in shape and wherein said oxide is deposited on the hemispherical external face of said metal.

8. The composite as claimed in claim 7, wherein said thin layer has a thickness of about 50 $\mu$m.

* * * * *